US011318777B2

(12) United States Patent
Nakajima

(10) Patent No.: US 11,318,777 B2
(45) Date of Patent: May 3, 2022

(54) APPLICATOR

(71) Applicant: MITSUBISHI PENCIL COMPANY, LIMITED, Tokyo (JP)

(72) Inventor: Toru Nakajima, Tokyo (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 17/152,841

(22) Filed: Jan. 20, 2021

(65) Prior Publication Data

US 2021/0221162 A1 Jul. 22, 2021

(30) Foreign Application Priority Data

Jan. 22, 2020 (JP) ..... JP2020-008440

(51) Int. Cl.
*B43K 5/18* (2006.01)
*B43K 8/03* (2006.01)

(52) U.S. Cl.
CPC ..... *B43K 5/1872* (2013.01); *B43K 8/03* (2013.01); *B43K 5/1827* (2013.01); *B43K 5/1836* (2013.01)

(58) Field of Classification Search
CPC ..... B43K 5/1872; B43K 8/03; B43K 5/1827; B43K 5/1818; B43K 5/1836; B43K 5/18; B43K 8/02; B43K 8/026; A46B 11/0041; A46B 11/00; A46B 11/001; A46B 11/002; A46B 11/0079; A46B 11/0082
USPC ..... 401/98, 199, 204–206, 183–186; 222/206, 212
See application file for complete search history.

(56) References Cited

U.S. PATENT DOCUMENTS 4,102,476 A * 7/1978 Loeffler ..... B05B 11/046 222/209
2,996,750 A 8/1981 Cholet
5,735,624 A 4/1998 O'Connor et al.
5,927,565 A * 7/1999 Paczonay ..... B65D 47/243 222/484

(Continued)

FOREIGN PATENT DOCUMENTS

JP 2001-63276 A 3/2001
JP 2001-80278 A 3/2001

(Continued)

OTHER PUBLICATIONS

Extended European Search Report dated Jun. 2, 2021 in European Patent Application No. 21152289.1, 7 pages.

*Primary Examiner* — David J Walczak
(74) *Attorney, Agent, or Firm* — Oblon, McClelland, Maier & Neustadt, L.L.P.

(57) ABSTRACT

An applicator includes a valve mechanism that communicates an application liquid tank and an applying part. The valve mechanism has at least a valve stem and a valve holder for holding the valve stem therein, the application liquid can flow through a gap between the valve stem and the valve holder, the valve stem is formed with an air exchange hole, and, the air exchange hole can be opened and closed by an opening/closing member that opens/closes when the pressure on the application liquid tank side becomes negative or positive compared to that on the applying part side. The applicator is capable of exchanging air after discharging the application liquid even if the applicator is equipped with a valve mechanism that opens its valve by increasing the internal pressure of the ink tank.

14 Claims, 7 Drawing Sheets

(56) References Cited

U.S. PATENT DOCUMENTS

| | | | | |
|---|---|---|---|---|
| 6,106,180 | A | 8/2000 | Anderka | |
| 6,332,730 | B1 * | 12/2001 | Taghavi-Khanghah | ..... B65D 35/20 222/212 |
| 6,554,521 | B1 | 4/2003 | Kobayashi | |
| 6,837,640 | B2 | 1/2005 | Kobayashi | |
| 8,128,304 | B2 | 3/2012 | Kurita et al. | |
| 2003/0123922 | A1 | 7/2003 | Kabayashi | |
| 2007/0212159 | A1 | 9/2007 | Kurita et al. | |

FOREIGN PATENT DOCUMENTS

| | | | |
|---|---|---|---|
| JP | 2004-136538 | A | 5/2004 |
| JP | 2005-343097 | A | 12/2005 |
| JP | 2008-183896 | A | 8/2008 |

* cited by examiner

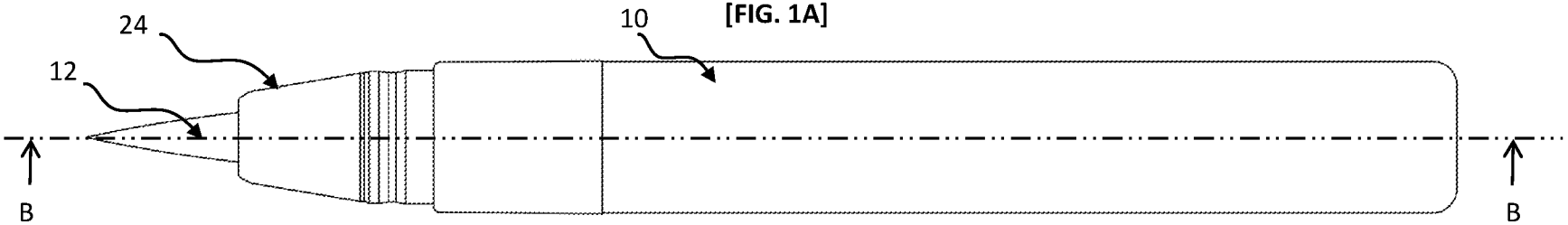
[FIG. 1A]
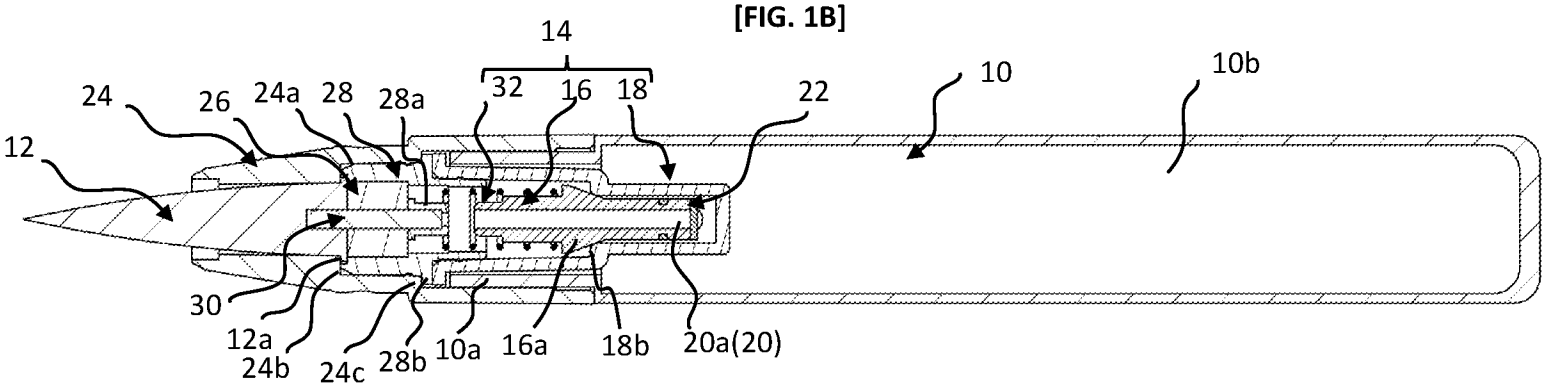
[FIG. 1B]
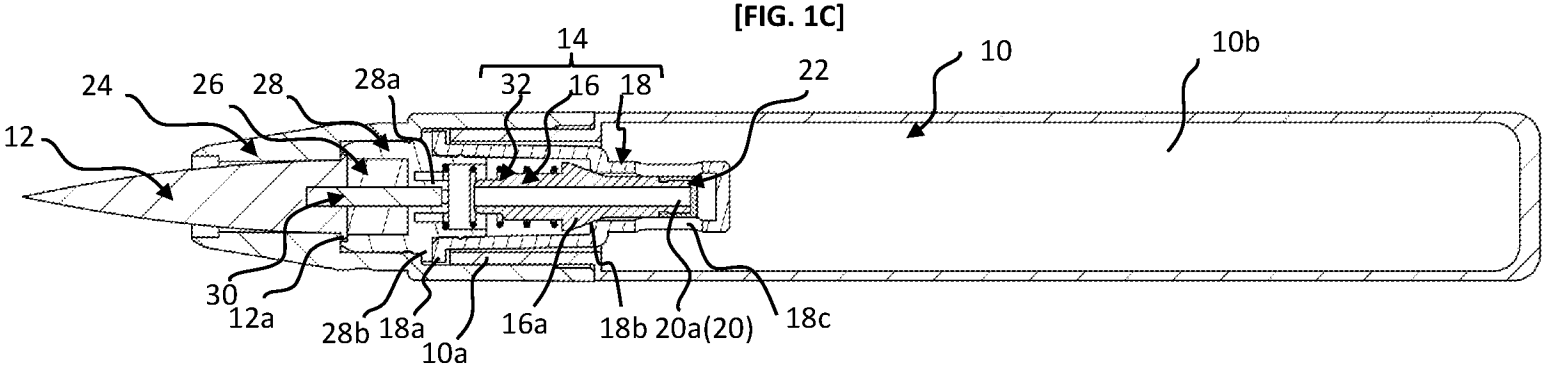
[FIG. 1C]

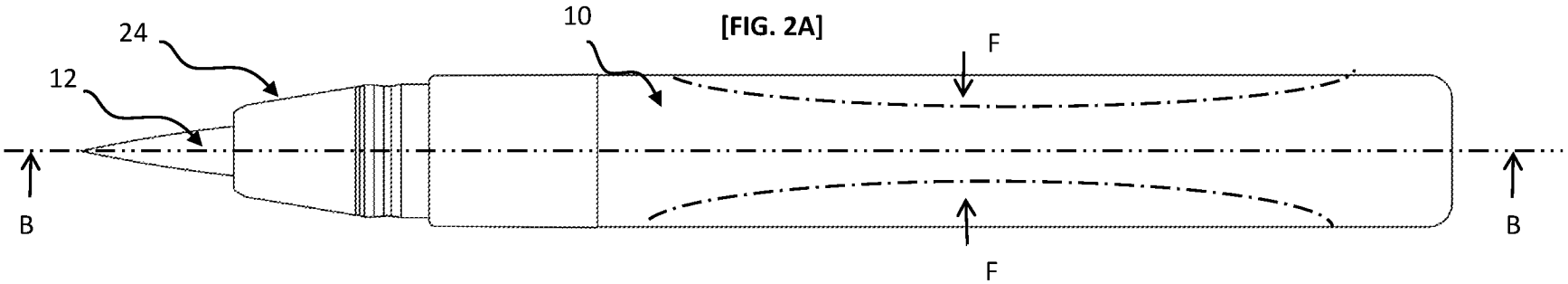
[FIG. 2A]
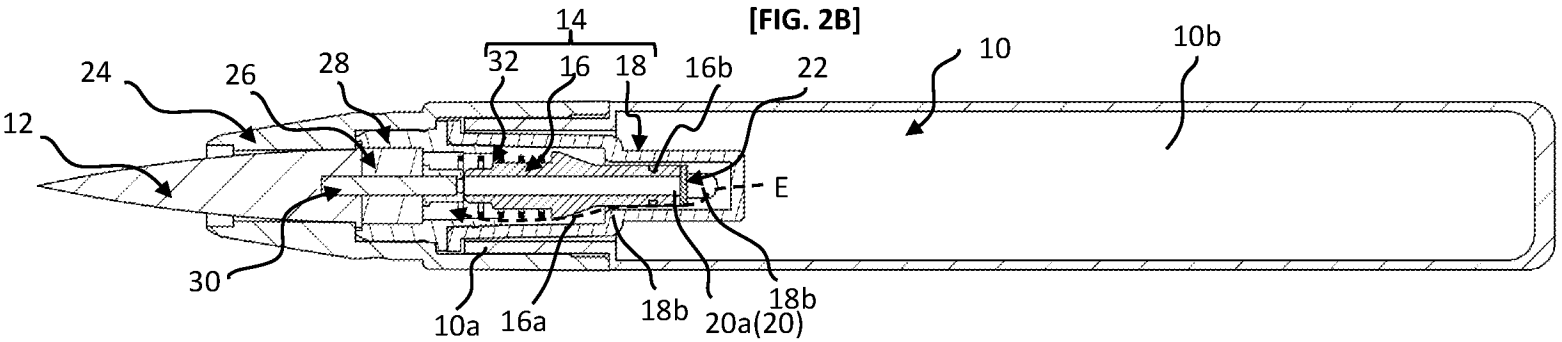
[FIG. 2B]
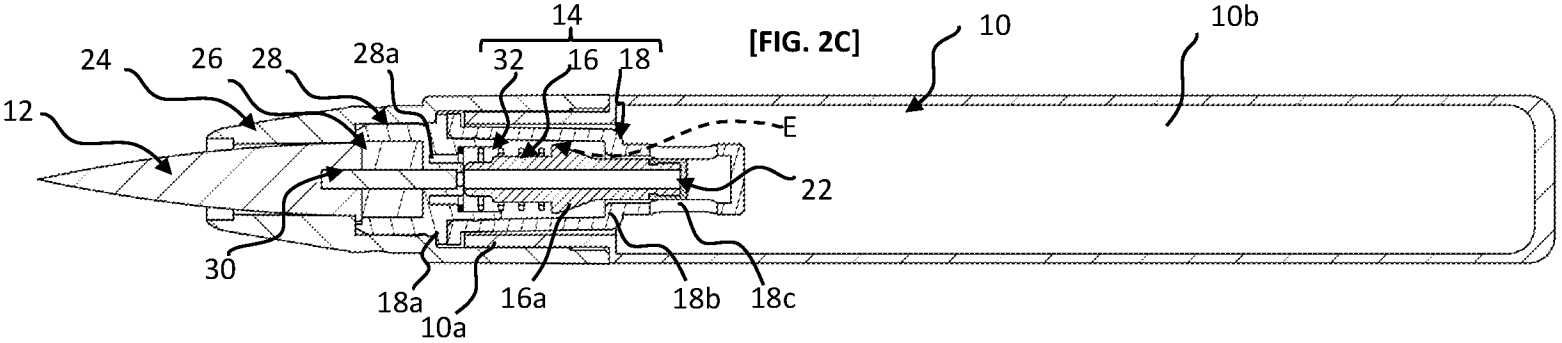
[FIG. 2C]

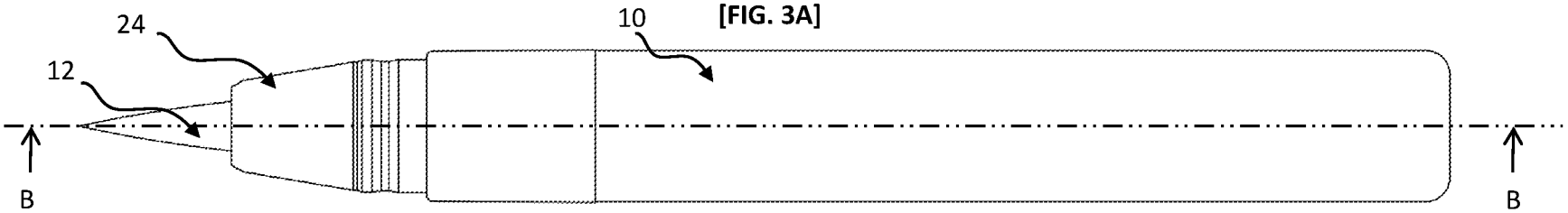
[FIG. 3A]
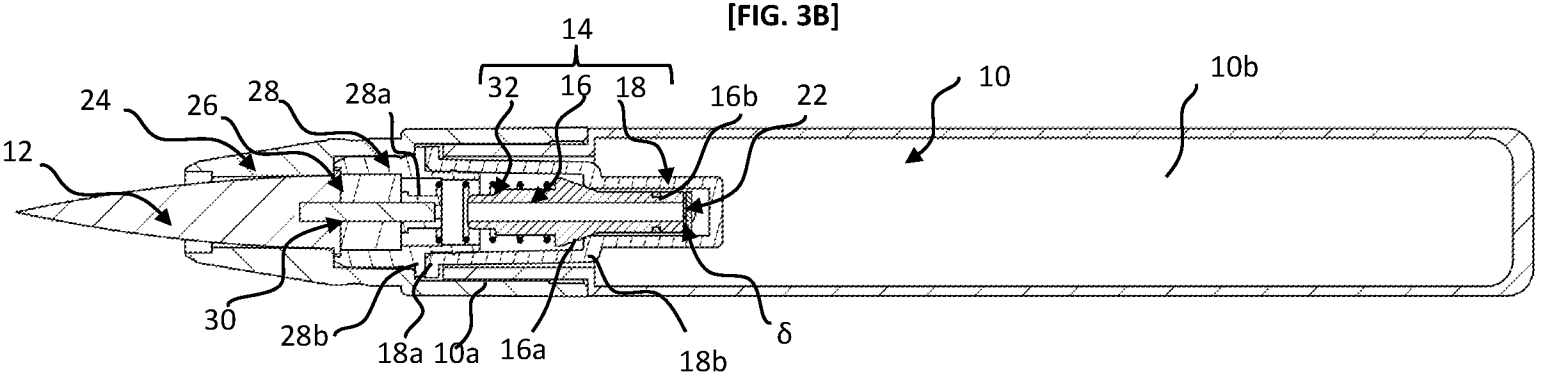
[FIG. 3B]
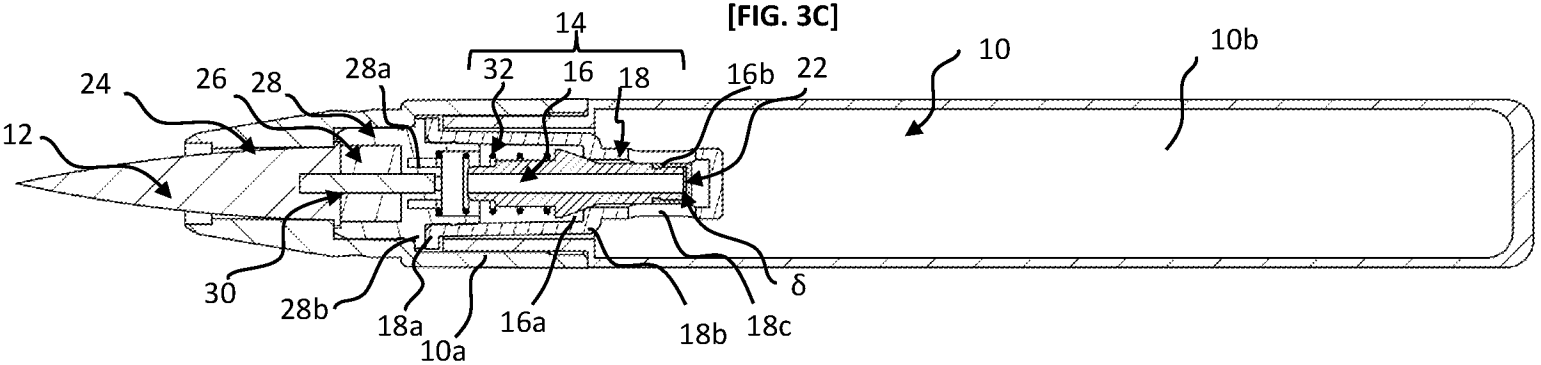
[FIG. 3C]

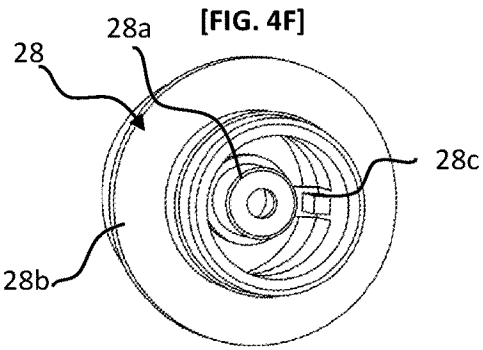
[FIG. 4F]
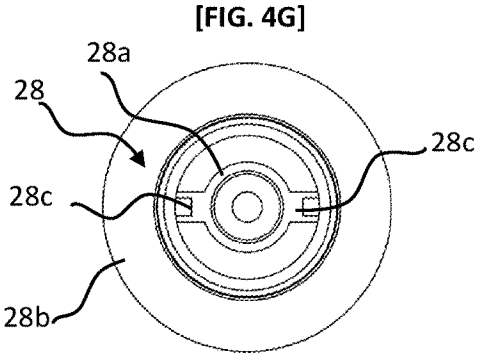
[FIG. 4G]
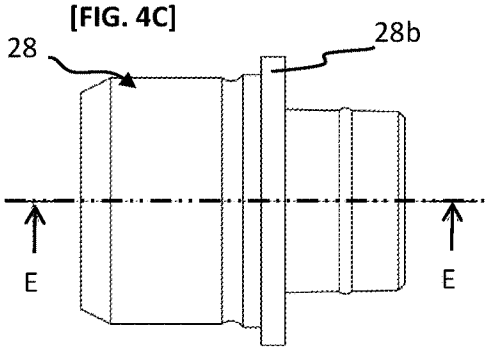
[FIG. 4C]
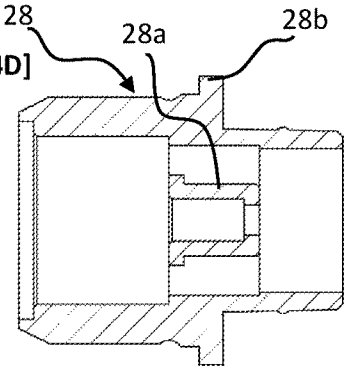
[FIG. 4D]
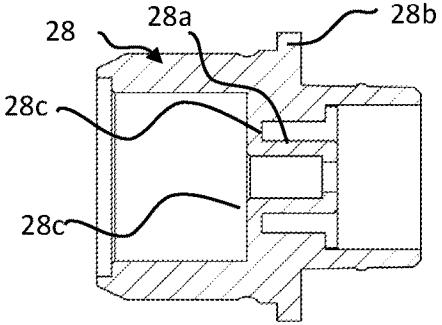
[FIG. 4E]
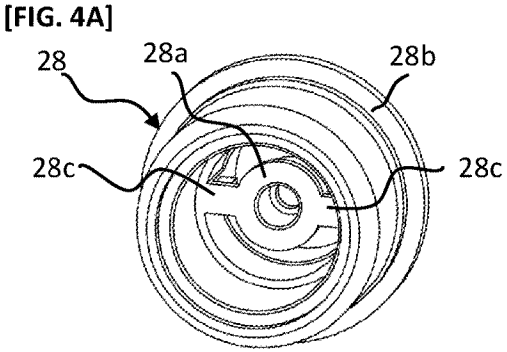
[FIG. 4A]
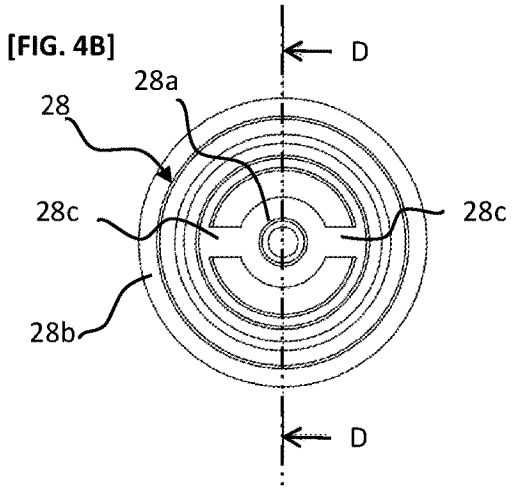
[FIG. 4B]

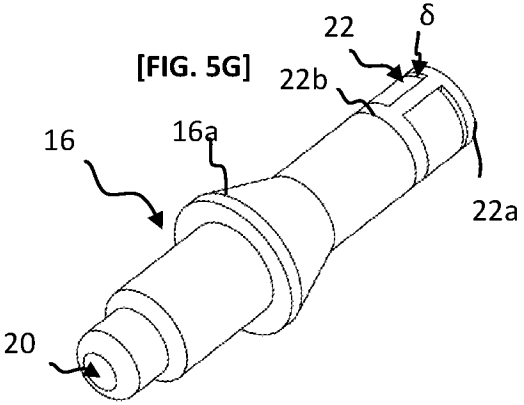
[FIG. 5G]
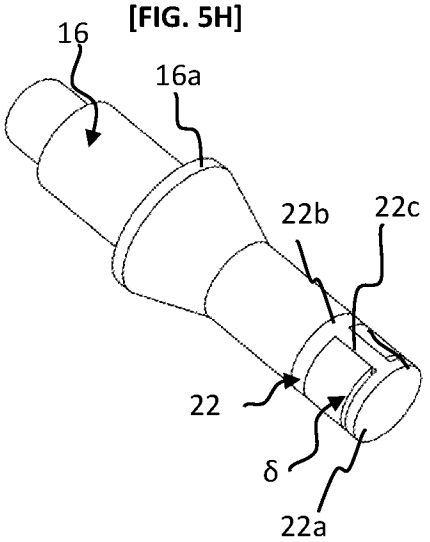
[FIG. 5H]
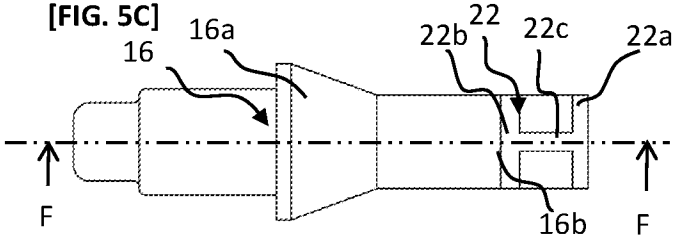
[FIG. 5C]
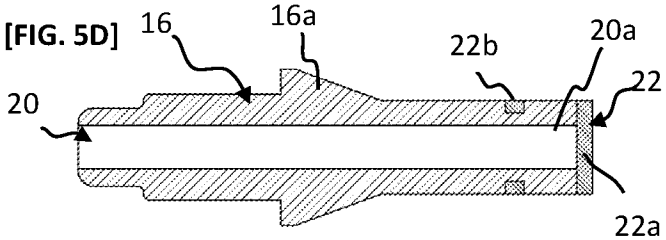
[FIG. 5D]
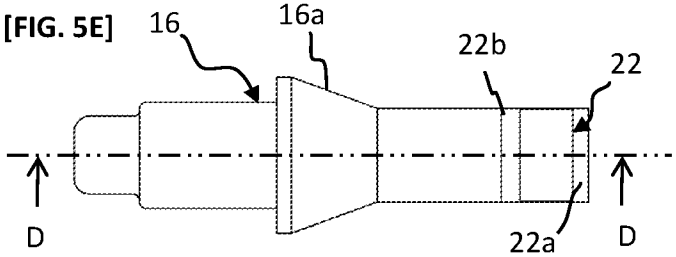
[FIG. 5E]
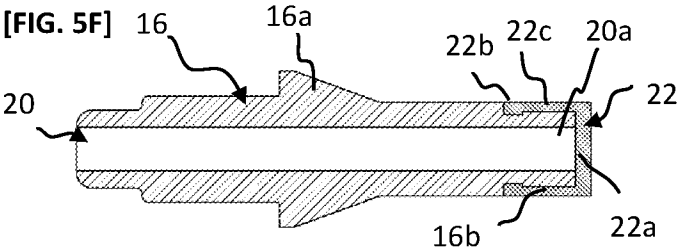
[FIG. 5F]
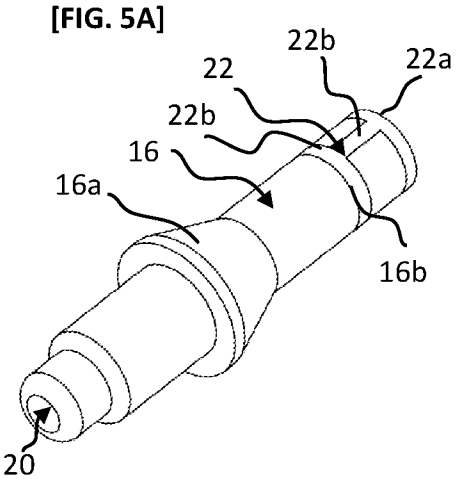
[FIG. 5A]
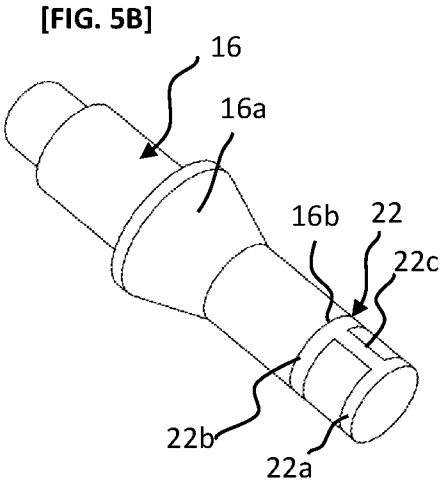
[FIG. 5B]

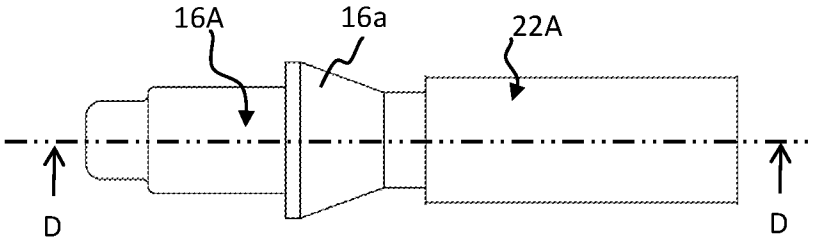
[FIG. 6C]
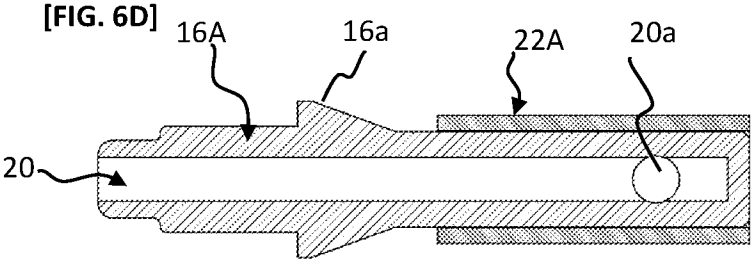
[FIG. 6D]
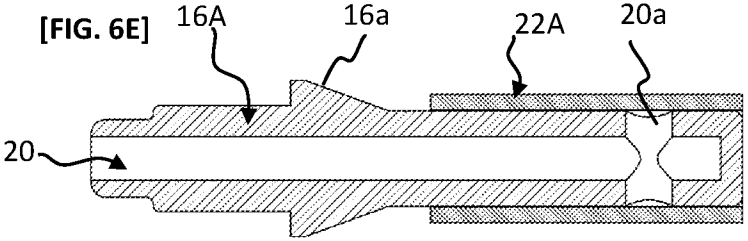
[FIG. 6E]
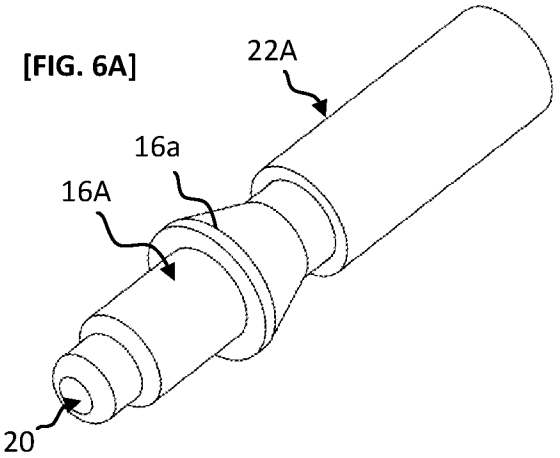
[FIG. 6A]
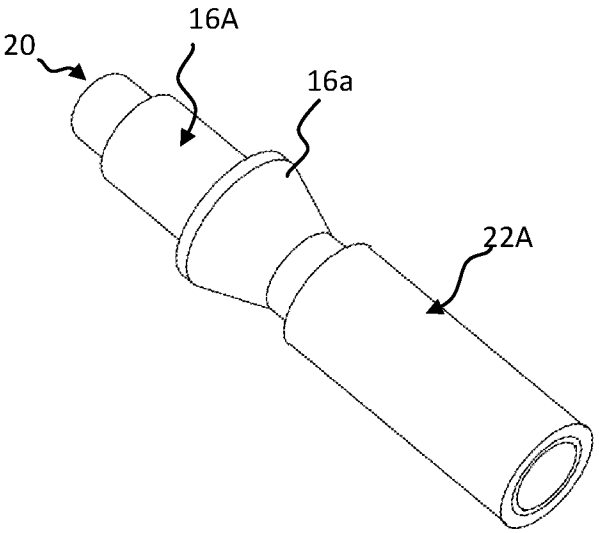
[FIG. 6B]

[FIG. 7B]
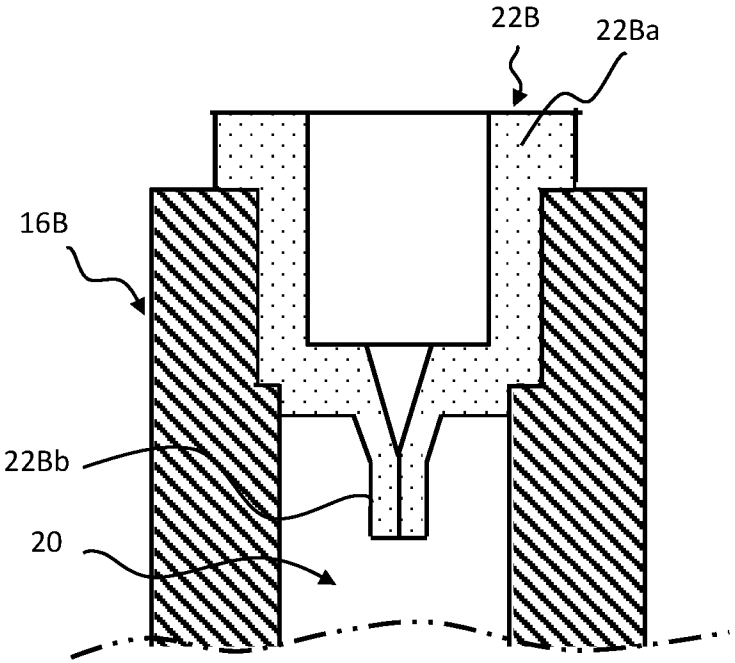
[FIG. 7A]
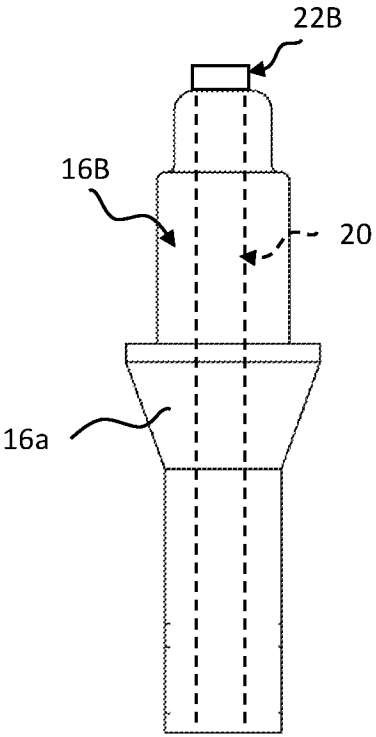

APPLICATOR

This Nonprovisional application claims priority under 35 U.S.C. § 119(a) on Patent Application No. 2020-008440 filed in Japan on 22 Jan. 2020, the entire contents of which are hereby incorporated by reference.

TECHNICAL FIELD OF THE INVENTION

The present invention relates to an applicator that supplies an application liquid in an ink tank to an applying part.

DESCRIPTION OF THE RELATED ART

When the amount of application liquid in the ink tank decreases, the pressure inside the ink tank becomes negative and it becomes difficult for the liquid to flow out, so air exchange is necessary.

Patent Document 1 discloses a direct-liquid writing instrument in which a long communication pipe (flow hole) is arranged to extend into the ink tank from the partition wall behind the ink absorbent body while another short communication pipe (flow hole) is arranged to supply ink therethrough, so as to prevent the ink from being blown out by allowing the long communication pipe to exchange air.

However, this writing instrument needs installation of the long communication pipe inside the ink tank, so that the ink tank and barrel cylinder becomes large.

Further, Patent Documents 2 to 5 disclose applicators having pen tip pressing type valve mechanisms. These are configured to open the valve mechanism so as to allow the application liquid to flow when the pen tip is pressed from the front.

However, when the writing part is a brush type, the rigidity of the brush is low so that the valve mechanism becomes difficult to operate when the brush is pressed from the front. That is, these applicators are not suitable for being applied to brush type applicators.

In order to deal with the problem of the applicators with a flexible applying part while avoiding bulkiness of the ink tank, applicators using a valve mechanism that opens its valve by applying an increased pressure on the ink tank have been devised, instead of applicators using a long communication tube as in Patent Document 1 and instead of applicators using a valve mechanism that opens its valve as the applying part is pressed as disclosed in Patent Documents 2 to 5.

There is an example of an applicator which includes an ink tank made of a blow molded container that can be deformed by pressing in the radial direction and a valve mechanism that opens its valve to discharge ink by increasing the inner pressure of the tank higher than the outside pressure by pressing or deforming the ink tank. Since this applicator can discharge ink as the inner pressure is increased by deforming the ink tank, this structure can be applied to a flexible applying part without upsizing the ink tank.

PRIOR ART DOCUMENTS

Patent Documents

[Patent Document 1]

Japanese Patent Application Laid-open No. 2008-183896

[Patent Document 2]

Japanese Patent Application Laid-open No. 2005-343097

[Patent Document 3]

Japanese Patent Application Laid-open No. 2001-63276

[Patent Document 4]

Japanese Patent Application Laid-open No. 2001-80278

[Patent Document 5]

Japanese Patent Application Laid-open No. 2004-136538

SUMMARY OF THE INVENTION

Problems to be Solved by the Invention

However, in the applicator using a valve mechanism that opens its valve by increasing the internal pressure of the ink tank, when, after the internal pressure is raised and the application liquid is discharged, the internal pressure is lowered by releasing the pressing force on the ink tank, the internal pressure becomes negative. In this this case, the valve mechanism does not operate and air exchange cannot be done, which is a problem. For example, an applicator that increases the internal pressure by deforming its ink tank cannot perform air exchange after ejection of ink, giving rise to a problem that the ink tank remains deformed without being able to be restored to its original shape.

In view of the above problems, it is therefore an object of the present invention to provide an applicator capable of exchanging air after discharging the application liquid even if the applicator is equipped with a valve mechanism that opens its valve by increasing the internal pressure of the ink tank.

Means for Solving Problems

The aspect of the present invention resides in an applicator comprising a valve mechanism that communicates an application liquid tank and an applying part, wherein: the valve mechanism has at least a valve stem and a valve holder for holding the valve stem therein; an application liquid can flow through a gap between the valve stem and the valve holder; the valve stem is formed with an air exchange hole; and, the air exchange hole can be opened and closed by an opening/closing member that opens/closes when the pressure on the application liquid tank side becomes negative or positive compared to that on the applying part side.

Effect of the Invention

According to the applicator of the present invention, the valve mechanism allows the application liquid to flow through the gap between the valve stem and the valve holder, and the valve stem is formed with an air exchange hole, which can be opened and closed by an opening/closing member that opens/closes when the pressure on the application liquid tank side becomes negative or positive compared to that on the applying part side. Since the opening/closing member is opened to exchange air when the pressure in the application liquid tank becomes negative after discharge of the application liquid, it is possible to surely eliminate the state where the inside of the application liquid tank remains in a negative pressure after discharge of the application liquid. Therefore, the present invention can provide excellent effect of solving the defective outflow problem that the application liquid tank remains in a negative pressure state at the time of using the applicator.

BRIEF DESCRIPTION OF THE DRAWINGS

FIG. 1 (1A to 1C) is an overall explanatory diagram of an applicator according to an embodiment of the present invention, FIG. 1A an external view, FIG. 1B a vertical cross-section taken along a line B-B in FIG. 1A, and FIG. 1C a vertical cross-section of a state where FIG. 1B is rotated 90° in the circumferential direction;

FIG. 2 (2A to 2C) is an explanatory diagram of the applicator of FIG. 1 in a state where a valve stem is advanced by pressing a barrel cylinder, FIG. 2A an external view, FIG. 2B a vertical cross-section taken along a line B-B in FIG. 2A, and FIG. 2C a vertical cross-section of a state where FIG. 2B is rotated 90° in the circumferential direction;

FIG. 3 (3A to 3C) is an explanatory diagram of the applicator of FIG. 1 in a state where an opening/closing member of an air exchange hole is opened when the valve stem is retracted by releasing the pressing of the barrel cylinder, FIG. 3A an external view, FIG. 3B a vertical cross-section taken along a line B-B in FIG. 3A, and FIG. 3C a vertical cross-section of a state where FIG. 3B is rotated 90° in the circumferential direction;

FIG. 4 (4A to 4G) is a part diagram of an absorbent body socket for holding an absorbent body (sponge) of an application liquid in the applicator of FIG. 1, FIG. 4A is a perspective view from the front, FIG. 4B a front view, FIG. 4C an external view, FIG. 4D a vertical cross-section taken along a D-D line in FIG. 4B, FIG. 4E a vertical cross-section taken along a line E-E in FIG. 4C, FIG. 4F a perspective view from the rear, and FIG. 4G a rear view;

FIG. 5 (5A to 5H) is an partial assembly diagram of the valve stem and the opening/closing member in the applicator of FIG. 1, FIG. 5A a perspective view from the front, FIG. 5B a perspective view from the rear, FIG. 5C an external view, FIG. 5D a vertical cross-section taken along a line D-D in FIG. 5E, FIG. 5E an external view in a state where FIG. 5C is rotated 90° in the circumferential direction, and FIG. 5 a vertical cross-section taken along a line F-F in FIG. 5C, FIG. 5G a perspective view of the opening/closing member in a valve open state, viewed from the front, and FIG. 5H a perspective view of the opening/closing member in the valve open state, viewed from the rear;

FIG. 6 (6A to 6E) is a partial assembly diagram of a valve stem and an opening/closing member according to a modification 1 of the applicator of the embodiment, FIG. 6A a perspective view from the front, FIG. 6B a perspective view from the rear, FIG. 6C an external view, FIG. 6D a vertical cross-section taken along a line D-D in FIG. 6C, FIG. 6E a vertical cross-section in a state where FIG. 6C is rotated 90° in the circumferential direction; and, FIG. 7 (7A to 7B) is a partial assembly diagram of a valve stem and an opening/closing member according to a modification 2 of the applicator of the embodiment, FIG. 7A an external view of the valve stem with the opening/closing member attached, and FIG. 7B a detailed cross-section of the opening/closing member.

DESCRIPTION OF THE PREFERRED EMBODIMENTS

Modes for Carrying Out the Invention

Hereinafter, embodiments of the present invention will be described with reference to the accompanying drawings.

FIGS. 1 to 3 are overall explanatory diagrams of an applicator according to an embodiment, FIGS. 4 to 5 are part diagrams, and FIGS. 6 to 7 show modifications of the parts.

As shown in FIG. 1, the applicator is provided with a valve mechanism 14 that communicates an application liquid tank 10 and an applying part 12.

The valve mechanism 14 includes a valve stem 16 and a valve holder 18 for holding the valve stem 16, and the valve mechanism 14 is constructed so as to allow the application liquid to flow through the gap between the valve stem 16 and the holder 18 when the pressure inside the application liquid tank 10 becomes higher than the outside pressure.

The valve stem 16 is formed with an air exchange hole 20, which can be opened and closed by an opening/closing member 22 that opens/closes when the application liquid tank 10 side becomes negative or positive in pressure compared to the applying part 12 side.

The air exchange hole 20 of the valve stem 16 is formed along the axial direction.

The opening/closing member 22 is arranged in an opening 20*a* on the application liquid tank 10 side of the air exchange hole 20. The opening/closing member 22 opens the opening 20*a* to allow air to flow for air exchange when the internal pressure of the application liquid tank 10 becomes negative, and closes the opening to prevent the application liquid from flowing into the air exchange hole 20 when the internal pressure becomes positive, thus producing a check valve.

Next, each part will be explained in detail.

[Applying Part 12]

The applying part 12 has a tapered brush shape and is formed of a bundle of fibers. The applying part may be one that has a tapered form of an artificial material such as a fibrous or a porous resin material, or a bundle of natural product fibers. Examples of the material include PET (polyethylene terephthalate) and PBT (polybutylene terephthalate).

The rear end portion of the applying part 12 is bundled and fixed by thermal fusing or the like to be formed with a flange 12*a* having an enlarged diameter.

[Application Liquid Tank 10]

The application liquid tank 10 is a barrel cylinder integrated with the outer peripheral wall from the central portion to the rear portion of the applicator, and the application liquid tank 10 has a functional part that discharges the application liquid by radial deformation of the barrel cylinder.

The application liquid tank 10 has a main body 10*b* that forms a flexible container and a front end part 10*a* that is made smaller in diameter than the main body. The rear portion of a front barrel 24 is fitted on the front end part 10*a*.

Specifically, the application liquid tank is a blow-molded flexible resin container having such a thickness as to elastically deform and increase the internal pressure when pressed in the radial direction by fingers. The application liquid tank 10 is a container of a barrel cylinder that the user holds in their hand to perform an applying operation. When the application liquid needs to be supplied, the application liquid tank is pressed in the radial direction with fingers to deform and reduce the interior volume to thereby increase the internal pressure.

The application liquid tank 10 may be made of resin material such as PP (polypropylene), PE (polyethylene), PS (polystyrene), PET (polyethylene terephthalate), PC (polycarbonate), PA (polyamide), POM (polyacetal), PES (polyether sulfone), PEN (polyethylene naphthalate), vinyl chloride, EVOH (ethylene vinyl alcohol copolymer resin), PBT (polybutylene terephthalate), ABS (acrylonitrile butadiene styrene copolymer synthetic resin), or metal material such as stainless steel, iron, brass, copper and aluminum, as appropriate, and may be formed by a resin molding method such as blow molding, vacuum molding and injection molding, by one or combination of multiple metal processing methods such as cutting work, drawing, and press molding, or by forming a sealed bag with a thin film material such as a resin film, a metal foil by bonding, fusing, sewing, or any other method.

[Front Barrel 24]

The front barrel 24 is formed in a substantially tubular hollow (mounting hole 24*a*) having a tapered front portion, and the applying part 12 is inserted with its front exposed.

In the mounting hole 24*a* inside the front barrel 24, front and rear steps 24*b* and 24*c* are formed so that the inner diameter of the hollow becomes greater stepwise as it goes from the front to the rear.

The flange 12*a* which is large in diameter at the rear end of the applying part 12 is caught by the front step 24*b* inside the front barrel 24 to prevent the applying part from falling off. Inside the mounting hole 24*a*, an absorbent body socket 28 for holding an absorbent body 26 of the application liquid is mounted on the rear side of the flange 12*a*. The application liquid feeder 30 penetrates the axial core of the absorbent body 26 in the front-rear direction, and the front portion of the application liquid feeder 30 is inserted into the rear portion of the applying part 12 while the rear portion of the application liquid feeder 30 is fitted to and supported by an inner cylindrical portion 28*a* of the absorbent body socket 28.

[Absorbent Body Socket 28]

A flange 28*b* having an enlarged diameter is formed on the outer peripheral side of the absorbent body socket 28. The front face of the flange 28*b* abuts the rear step 24*c* of the front barrel 24 while the rear face of the flange 28*b* abuts the flange-shaped front end 18*a* of the valve holder 18 in the valve mechanism 14, so that the absorbent body socket is held and fixed between the front barrel 24 and the valve holder 18 inside the front barrel.

As shown in FIG. 4, the absorbent body socket 28 has a substantially cylindrical shape, and its outer peripheral portion has the flange 28*b* in the middle, which is larger in diameter than the front portion, whereas the outer peripheral portion behind the flange 28*b* is smaller in diameter than the front portion. A pair of beams 28*c* extending radially outward from the inner cylindrical portion 28*a* are integrally formed on the inner periphery of the absorbent body socket 28, so that the inner cylindrical portion 28*a* is fixed and supported. The front end faces of the inner cylindrical portion 28*a* and the beams 28*c* are flush with each other. This front endface serves as a receiving surface for the rear endface of the absorbent body 26 (see FIG. 1).

Therefore, the absorbent body 26 (see FIG. 1) is held in the absorbent body socket 28 with its outer peripheral side in contact with the inner peripheral surface of the absorbent body socket 28 and its rear endface abutted and supported by the front endface of the inner cylindrical portion 28*a* and the beams 28*c*.

Regarding air exchange, with the application liquid feeder 30 (see FIG. 1) fitted in the inner cylindrical portion 28*a*, the hollows between the beams 28*c* and 28*c* constitute flow holes for the application liquid and an air exchange passage. An annular recess is formed on the outer peripheral surface in front of the flange 28*b* of the absorbent body socket 28, whereby the absorbent body socket is fitted in and fixed to the front barrel 24. Further, an annular rib is formed on the outer peripheral surface behind the flange 28*b*, whereby the absorbent body socket is fitted and fixed to the valve holder 18.

Examples of the so-called sponge material for the absorbent body 26 include fiber bundles of natural fiber, synthetic resin fiber, fiber bundle bodies processed from fiber bundles of felt or the like, hard sponge, and resin particle porous bodies and the like formed of resin particle sintered bodies. The application liquid feeder 30 is configured so that the capillary force of the application liquid feeder 30 is higher than that of the absorbent body 26, and may use a fiber bundle formed of one or a combination of natural fiber, animal hair fiber, polyacetal resin, acrylic resin, polyester resin, polyamide resin, polyurethane resin, polyolefin resin, polyvinyl resin, polycarbonate resin, polyether resin, polyphenylene, a processed product of a fiber bundle such as felt, hard sponge, resin particle porous body of resin particle sintered material, and a continuous porous passage formed of sliver core etc.

[Valve Mechanism 14]

As shown in FIG. 1, the valve mechanism 14 includes the valve stem 16, the valve holder 18 for holding the valve stem 16 and a spring 32 for urging the valve stem rearward against the valve holder.

The valve holder 18 is fixed so that the front end 18*a* is in contact with the rear face of the flange 28*b* of the absorbent body socket 28 while the front end 18*a* and the flange 28*b* are sandwiched between the rear step 24*c* in the front barrel 24 and the front end part 10*a* of the application liquid tank 10.

The valve holder 18 is a substantially cylindrical body that has a smaller diameter in the rear portion than in the front portion via a step 18*b* and a closed rear end, and an application liquid flow hole 18*c* is formed in the side wall of the rear portion.

The valve stem 16 is a substantially tubular rod-like body that has an air exchange hole 20 formed inside, and an annular projected portion 16*a* having a backward inclined surface (tapered surface that narrows rearward) is formed on the outer peripheral surface.

Inserted between the front face of the annular projected portion 16*a* and the absorbent body socket 28 (the rear face of the beams 28*c*) is a coil spring 32 made of resin or metal, which urges the stem 16 rearward. This urging force keeps contact between the backward slope of the annular projected portion 16*a* and the front interior face of the step 18*b*.

As shown in FIG. 5, the valve stem 16 has a small diameter in the front end and the annular projected portion 16*a* formed so as to protrude on the outer peripheral side in the middle part thereof. The opening/closing member 22 for opening/closing the opening 20*a* of the air exchange hole 20 is attached to the rear end of the valve stem. A mounting structure 16*b* in the rear end of the valve stem 16 of the embodiment is composed of a circumferential groove surrounding the outer peripheral side and a longitudinal groove extending from the circumferential groove to the rear endface.

[Opening/Closing Member 22]

As shown in FIG. 5, the opening/closing member 22 has a disk-shaped valve portion 22*a*, a ring-shaped portion 22*b* spaced from the valve portion 22*a*, and a joint 22*c* that connects the valve portion 22*a* and the ring-shaped portion 22*b* in the front-rear direction, which are integrally formed of a rubber-like elastic material. The rubber-like elastic material of the opening/closing member 22 may use, for example, NBR, silicone rubber, EPDM, fluorosilicone rubber, fluororubber, urethane rubber, natural rubber, chloroprene rubber, butadiene rubber, butyl rubber, styrene-based elastomer, vinyl chloride-based elastomer, olefin-based elastomer, polyester-based elastomer, polyamide-based elastomer, urethane-based elastomer and the like.

In the state where the opening/closing member 22 is set on the valve stem 16, the valve portion 22*a* closes the rear end opening of the air exchange hole 20 of the valve stem 16, the ring-shaped portion 22*b* fits in the circumferential groove of the mounting structure 16*b*, and the joint 22*c* fits in the longitudinal groove to create an airtight condition.

When the internal pressure of the application liquid tank 10 (see FIG. 1) becomes lower than the outside air pressure, the pressure in the air exchange hole 20 increases, so that the joint 22*c* is stretched thanks to elastic deformation, as shown in FIGS. 5G and 5H, and the valve portion 22*a* floats from the rear endface of the valve stem 16 to create a gap δ and open the opening/closing member 22. Therefore, air is exchanged through the air exchange hole 20.

The valve stem 16 and the opening/closing member 22 may be integrally molded by two-color molding or the like, and in that case, the valve stem 16 and the opening/closing member 22 are preferably formed of non-adhesive materials.

Further, the air exchange hole 20 may be arranged in the radial direction instead of the axial direction, and multiple exchange holes 20 may be formed.

Further, depending on the ink stored in the tank, a stirring ball or the like that can stir the ink may be added.

The operation of the applicator according to the embodiment will be described.

[When the Application Liquid Tank 10 is Pressed to Deform and Pressurize]

As shown in FIG. 2, when the user of the applicator applies a radial force (indicated by reference numeral F) to the application liquid tank 10 by fingers, the application liquid tank 10 elastically deforms and the internal volume is reduced, so that the internal pressure increases compared to the outside air pressure. This difference in pressure generates a force for moving the valve stem 16 of the valve mechanism 14 forward. When the force exceeds the urging force of the spring 32, the valve stem 16 moves forward and the annular projected portion 16*a* of the valve stem 16 separates from the step 18*b* of the valve holder 18 and opens the valve.

In the valve mechanism 14, when the valve is opened, the application liquid flows through the flow hole 18*c*, passing through the gap between the annular projected portion 16*a* and the step 18*b*, and reaches the vicinity of the inner cylindrical portion 28*a* (the flow of the application liquid is indicated by a broken line E). The application liquid is supplied to the applying part 12 via the application liquid feeder 30 in the inner cylindrical portion 28*a*. Further, the application liquid passes between the beams 28*c* and 28*c* of the absorbent body socket 28, flows to the rear face of the absorbent body 26, and is temporarily stored in the absorbent body 26. The application liquid temporarily stored in the absorbent body 26 is supplied to the applying part 12 through the application liquid feeder 30 even when the valve stem 16 is closed. When the application liquid flows forward and the internal pressure of the tank is released, the valve stem 16 of the valve mechanism 14 moves rearward from the urging force of the spring 32, and the annular projected portion 16*a* of the valve stem 16 abuts the step 18*b* of the valve holder 18 to close the valve.

[When Pressing on the Application Liquid Tank 10 is Stopped and the Tank is About to Return from the Deformed State to the Original State]

As shown in FIG. 3, when the pressing force acted by the fingers on the application liquid tank 10 is released, the elastic deformation of the application liquid tank 10 tries to return to the original state so that the internal volume increases. Resultantly, the internal pressure becomes lower than the outside air pressure, and becomes negative. The difference in pressure generates a pressure difference between the air exchange hole 20 inside the valve stem 16 in the application liquid tank 10 and the application liquid tank 10. Due to this pressure difference, as shown in FIGS. 3, 5G and 5H, the valve portion 22*a* floats from the rear endface of the valve stem 16 to create a gap δ, thus the opening/closing member 22 opens. Therefore, the application liquid tank 10 exchanges air through the air exchange hole 20.

According to the embodiment, the valve mechanism 14 enables the application liquid to flow through the gap between the valve stem 16 and the valve holder 18 while provision of the air exchange hole 20 in the valve stem 16 enables the opening/closing member 22 to open/close when the pressure becomes negative or positive compared to the applying part 12 side. Therefore, as shown in FIG. 3, the opening/closing member 22 opens to exchange air when the application liquid tank 10 becomes negative in pressure after release of the application liquid, so that the negative pressure in the application liquid tank 10 after release of the application liquid can be cancelled, thus making it possible to reliably eliminate continuation of the negative state.

As a result, when the applicator is used, the application liquid tank 10 does not remain in a negative pressure state during an outflow operation of the application liquid, so that the application liquid tank 10 returns to its original shape and the application liquid tank 10 can be deformed again and favorably pressurized. Thus, problems such as defective liquid outflow can be resolved.

[Modification 1: Valve Stem 16A and Opening/Closing Member 22A]

The opening/closing member is not limited to the embodiment. As a modification 1 shown in FIG. 6, an opening/closing member 22A can be formed as a band-shaped rubber elastic material that covers the surrounding area of openings 20*a* located on the application liquid tank 10 side of the air exchange hole 20. The same parts as those in FIGS. 1 to 3 and 5 are allotted with the same reference numerals.

In FIG. 6, the valve stem 16A is closed at the rear end thereof while openings 20*a* communicating with the air exchange hole 20 are formed on the side wall in the rear portion of the valve stem. The band-like opening/closing member 22A wide in the front-rear direction is formed so as to cover the openings 20*a*.

In a state where the valve mechanism 14 is closed as shown in FIG. 3, a pressure difference is generated between the air exchange hole 20 in the valve stem 16 and the application liquid tank 10 due to a negative pressure in the application liquid tank 10. This pressure difference creates, as shown in FIG. 6, a gap between the opening/closing member 22A and the outer surface of the valve stem 16A, so that the opening/closing member 22A opens. Therefore, the application liquid tank 10 can exchange air through the air exchange hole 20.

[Modification 2: Valve Stem 16B and Opening/Closing Member 22B]

In a modification 2 shown in FIG. 7, a valve stem 16B and an opening/closing member 22B are provided to form a check valve structure. This check valve structure is used to replace the valve stem 16 and the opening/closing member 22 in the applicator shown in FIGS. 1 to 3, whereas the other configurations of the applicator are overall the same.

The valve stem 16B has an air exchange hole 20 penetrating therethrough from the front end to the rear end, and no opening is formed on the side wall. The opening/closing member 22B is attached to a front end 16B*a* of the valve stem 16B. The opening/closing member 22B is formed of a rubber elastic material and comprises a bowl-shaped main part 22Ba and a funnel-shaped valve portion 22Bb, which is a smaller-diametric tubular part, extended, and tapered to the rear, from the main part. In a state where the valve mechanism 14 is closed as shown in FIG. 3, a pressure difference is generated between the front side of the valve stem 16 and the application liquid tank 10 due to a negative pressure in the application liquid tank 10. This pressure difference causes the opening/closing member 22B shown in FIG. 7 to open the valve portion 22Bb so that air is exchanged with the application liquid tank 10 (see FIG. 3) side through the air exchange hole 20. Thus, the application liquid tank 10 can exchange air via the opening/closing member 22B.

Other than the embodiment of the applicator, it is possible to provide an applicator which has a structure such that the application liquid tank is externally covered with a barrel cylinder while an actuator such as a knock mechanism is provided to change the internal pressure of the application liquid tank.

Industrial Applicability

The applicator of the present invention can be used as various applicators such as writing instruments, makeup tools, and paints. Particularly, the present invention is suitable for an applicator having a thin pen core or a soft pen core, which is difficult to pump with the pen tip.

DESCRIPTION OF REFERENCE NUMERAL

10 application liquid tank
12 applying part
14 valve mechanism
16 valve stem
16A valve stem (modification 1)
16B valve stem (modification 2)
16Ba front end
16*a* annular projected portion
16*b* mounting structure
18 valve holder
20 air exchange hole
20*a* opening
22 opening/closing member
22A opening/closing member (modification 1)
22B opening/closing member (modification 2)
26 absorbent body
28 absorbent body socket
30 application liquid feeder
32 spring

What is claimed is:

1. An applicator comprising:
a valve mechanism that communicates an application liquid tank and an applying part, wherein:
the valve mechanism has at least a valve stem and a valve holder for holding the valve stem therein;
an application liquid can flow through a gap between the valve stem and the valve holder;
the valve stem is formed with an air exchange hole; and
the air exchange hole can be opened and closed by an opening/closing member that opens/closes when the pressure on an application liquid tank side of the valve mechanism becomes negative or positive compared to that on an applying part side of the valve mechanism,
the opening/closing member is a check valve arranged at an opening on the application liquid tank side of the valve mechanism of the air exchange hole.

2. The applicator according to claim 1, wherein the air exchange hole is formed in the valve stem along the axial direction thereof.

3. The applicator according to claim 2, wherein the opening/closing member is a member made of a rubber elastic material that covers the opening of the air exchange hole on the application liquid tank side of the valve mechanism.

4. The applicator according to claim 2, wherein the opening/closing member is a check valve arranged at the opening on the application liquid tank side of the valve mechanism of the air exchange hole.

5. The applicator according to claim 2, wherein the application liquid tank is a flexible container.

6. The applicator according to claim 2, wherein the application liquid tank forms a barrel cylinder and provides the function of an actuator for causing the application liquid to flow out by deformation of the barrel cylinder.

7. The applicator according to claim 1, wherein the opening/closing member is a member made of a rubber elastic material that covers the opening of the air exchange hole on the application liquid tank side of the valve mechanism.

8. The applicator according to claim 7, wherein the application liquid tank is a flexible container.

9. The applicator according to claim 7, wherein the application liquid tank forms a barrel cylinder and provides the function of an actuator for causing the application liquid to flow out by deformation of the barrel cylinder.

10. The applicator according to claim 1, wherein the application liquid tank is a flexible container.

11. The applicator according to claim 1, wherein the application liquid tank is a flexible container.

12. The applicator according to claim 1, wherein the application liquid tank forms a barrel cylinder and provides the function of an actuator for causing the application liquid to flow out by deformation of the barrel cylinder.

13. The applicator according to claim 1, wherein the application liquid tank forms a barrel cylinder and provides the function of an actuator for causing the application liquid to flow out by deformation of the barrel cylinder.

14. The applicator according to claim 1, wherein the applying part has a tapered brush shape and is formed of a bundle of fibers.

* * * * *